US005433085A

United States Patent [19]

Rogers

[11] Patent Number: 5,433,085

[45] Date of Patent: Jul. 18, 1995

[54] CHILLED BEVERAGE DISPLAY CONTAINER

[75] Inventor: David M. Rogers, Winston-Salem, N.C.

[73] Assignee: Decision Point Marketing, Inc., Winston-Salem, N.C.

[21] Appl. No.: 195,560

[22] Filed: Feb. 14, 1994

[51] Int. Cl.[6] ..... F25D 3/08

[52] U.S. Cl. ..... 62/372; 62/464; 62/457.1

[58] Field of Search ..... 62/245, 246, 250, 329, 62/371, 372, 457.1, 457.5, 459, 464, 529

[56] References Cited

U.S. PATENT DOCUMENTS

| | | | |
|---|---|---|---|
| 309,233 | 12/1884 | Lhmann | 62/371 |
| 608,701 | 8/1898 | Morse | 62/459 |
| 2,453,017 | 11/1948 | Kaufman | 62/245 |
| 4,220,048 | 1/1980 | Grepiotis et al. | 73/323 |
| 4,724,682 | 7/1988 | Flum et al. | 62/462 |
| 4,946,032 | 4/1990 | Stoddard et al. | 206/44 |
| 4,982,840 | 9/1991 | Bidwell | 206/223 |
| 4,995,238 | 12/1991 | King | 62/125 |
| 5,048,171 | 6/1991 | Bidwell et al. | 29/401 |
| 5,048,305 | 9/1991 | Taub | 62/372 |
| 5,169,020 | 5/1992 | Spamer | 220/444 |
| 5,261,253 | 11/1993 | Spenard | 62/250 |

*Primary Examiner*—Henry Bennett
*Assistant Examiner*—William C. Doerrler
*Attorney, Agent, or Firm*—Rhodes, Coats & Bennett

[57] ABSTRACT

A container for holding ice and beverages includes a receptacle having an interior cavity with substantially vertical side walls, and a float positioned within the cavity to support beverages and ice, and move upwardly within the cavity as ice melts. Ribs may be added to the interior wall of the cavity to prevent tipping of the float.

27 Claims, 4 Drawing Sheets

CHILLED BEVERAGE DISPLAY CONTAINER

BACKGROUND OF THE INVENTION

The present invention relates to an improved chilled beverage display container for holding beverages and ice so that the beverages and unmelted ice are supported near the top of the container and separate from melted ice, or water.

Beverages, e.g., soft drinks or beer in cans or bottles, are often displayed at retail outlets in chilled containers, which are frequently located close to check-out counters to stimulate impulse purchases by departing customers. Normally, these containers are made of an open top receptacle having a bottom wall, a continuous upright side wall forming an interior cavity, and a drain positioned near the bottom wall to allow drainage of water. The receptacle cavity is filled with a quantity of beverages and ice to chill the beverages.

While these containers work well soon after filling, they become unsightly after the ice start to melt, resulting in emersion of the beverages. Moreover, removal becomes inconvenient since the purchaser must reach into the water to remove the beverages. This practice may also pose a health risk, since germs can be released from a customer's hand into the water. In addition, the distance that a customer can reach into a container is limited by the presence of the water and the distance to the bottom of the container, thus limiting the quantity of beverages that can be displayed.

Attempts have been made to address certain of these disadvantages. For example, U.S. Pat. No. 4,724,682 to Flum et. al. describes a chilled beverage container which includes a drainage tank beneath a beverage holder. As the ice in the beverage holder melts, the water drains into the tank, separating it from the ice and beverages.

U.S. Pat. No. 5,048,305 to Taub, describes a similar approach in which a beverage container has a lower sump zone comprised of spacers which support the beverages and ice above the water, which collects between the spacers.

Other chilled beverage containers are described in U.S. Pat. Nos. 4,995,238 to King; 5,169,020 to Spamer; 4,982,840 and 5,048,171 to Bidwell; and 4,946,032 to Stoddard.

Basically, the containers described in all of the above patents, as well as most containers commercially available, include an outer container having a height of about 30 to 40 inches which rests on the floor, and an inner container supported within the outer container. The bottom of this inner container is substantially above the bottom of the outer container, so that beverages near the bottom can be reached by customers. This configuration, while improving accessibility of the beverages, limits the number of beverages that can be loaded, thus requiring frequent reloading of the container.

The present application describes an improved chilled beverage container which allows the user to maintain beverages and unmelted ice separate from water formed by melting ice, thus in, proving the appearance of, and ease of access to, the beverages. It also allows loading with a large number of beverages, thus reducing the number of times it must be reloaded. Since the customers do not have to reach into the water to retrieve the beverages, the health risk is also reduced.

SUMMARY OF THE INVENTION

The present container includes a receptacle having an interior cavity defined by a generally horizontal bottom wall, and a continuous upright side wall having a lower edge integral with the periphery of the lower wall, and an upper edge forming the top rim of the receptacle.

The bottom wall, and the resulting horizontal cross-section of the receptacle, may be of different shapes, e.g., circular, resulting in a generally cylindrical receptacle, or triangular, resulting in a three-sided receptacle.

The bottom wall or lower side wall of the container will normally include a drain to allow drainage of water from the receptacle. A valve may be used to control flow from the drain.

The receptacle may also be mounted on a support base, which may have wheels or casters to promote ease of movement of the filled receptacle. A top may be attached to the top rim of the receptacle.

The receptacle walls may be formed of an outer section and an inner section with an intermediate space, which may be filled with an insulating material such as styrofoam to slow melting of the ice. The inner section may include a flange at its upper edge extending over the top of the outer surface and styrofoam, to provide protection and an area for attaching the top.

The beverages and unmelted ice are kept separate from the water in the container, and are made readily accessible to the purchaser, by the presence of a float having a density less than water within the cavity of the receptacle.

This float has a top wall extending substantially across the cross-section of the cavity to support the ice and beverages, and a side wall, which is preferably continuous, adjacent the interior surface of the receptacle side wall. As the ice melts, water flows under the float, which rides on the water surface and rises upwardly in the cavity to support the ice and beverages near the top of the container and separate from the water.

The float may be formed in a variety of ways, so long as it remains lighter than water while in contact with the water in the receptacle. For example, the float can be formed from blow-molded or injection molded plastic, or closed-cell styrofoam, preferably coated to reduce friction.

It is an important aspect of the present invention that the float not turn over while supporting the ice and beverages, since the ice and beverages would then slip under the float and into the water below. Therefore, The cross-section of the float upper wall should be substantially equal to the cross-section of the receptacle cavity.

One way to ensure that the float will not tip is to construct the float of a thickness such that the distance from a point on one edge of the side wall to a diametrically opposite point on the opposing edge of the side wall at an opposite point on the float is greater than the distance across the corresponding cross-section of the cavity. If so, tipping will be prevented, since the edges of the float will abut against the inner surface of the receptacle side wall.

If the receptacle, or at least the interior part thereof, is formed by plastic molding, the walls need not be substantially vertical, but instead, may diverge outwardly, thus increasing the cross-sectional diameter toward the top of the receptacle. This increase is due to the necessity of forming the receptacle in a configuration which will permit it to be released from the mold. If this increase in diameter is significant, it may be useful to include support ribs in the cavity interior.

The support ribs may be integrally formed in the inner side wall of the receptacle, or may be separately attached to the inner side wall. Generally, the support ribs will be substantially upright, and will extend from the top to the bottom of the cavity.

Each rib will have an inner face adjacent the side wall of the float, which will be of a size to extend from a rib on one side of the cavity to a rib on the opposite side. The inner rib faces may be, for example, semi-circular. When the ribs are attached to the inner face of the side wall, they will include an outer face, and shaped to fit against the interior cavity wall. Generally, from six to ten ribs, and preferably eight ribs, will be used.

The invention also provides a method of holding containers at a chilled temperature including providing a receptacle having a bottom wall and sidewalls and capable of holding water and locating a float at the bottom of the receptacle. Ice and the containers to be chilled are loaded into the receptacle on the float, and the ice is permitted to maintain the containers at a chilled temperature. Water drains from melted ice to the bottom of the receptacle below the float, and the float floats on the water, raising remaining containers and ice on the float in the receptacle as the amount of drained water from melted ice increases. The loading step preferably includes substantially entirely filling the receptacle.

The method may include removing a container after the draining step so as to decrease the weight supported by the float and thereby permit more of the float to emerge from drained water to raise the remaining containers and ice on the float.

DETAILED DESCRIPTION OF THE PREFERRED EMBODIMENT

Figure 1:
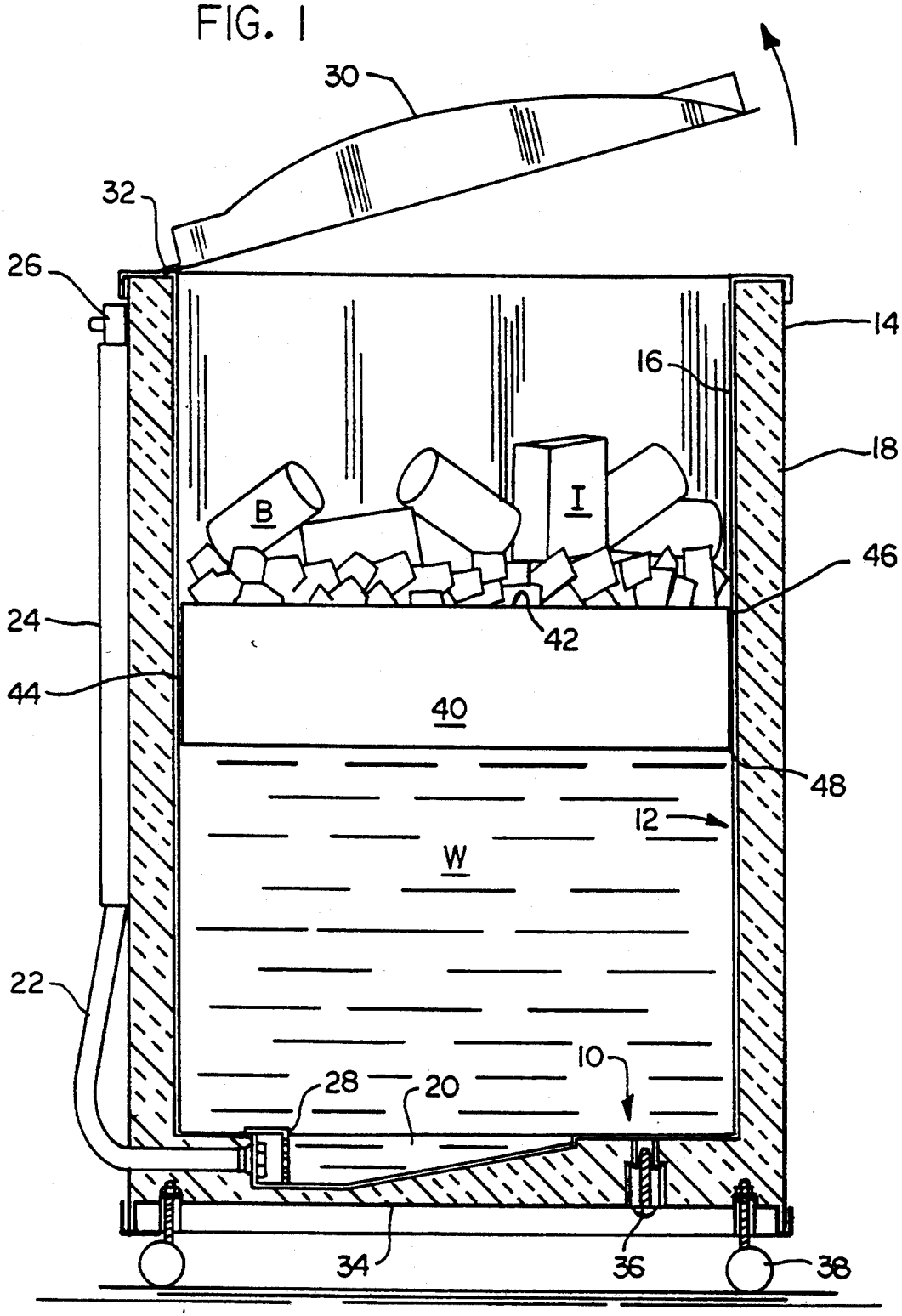
FIG. 1 is a cross-sectional plan view of a container of the present invention with a substantially vertical side wall.
Figure 2:
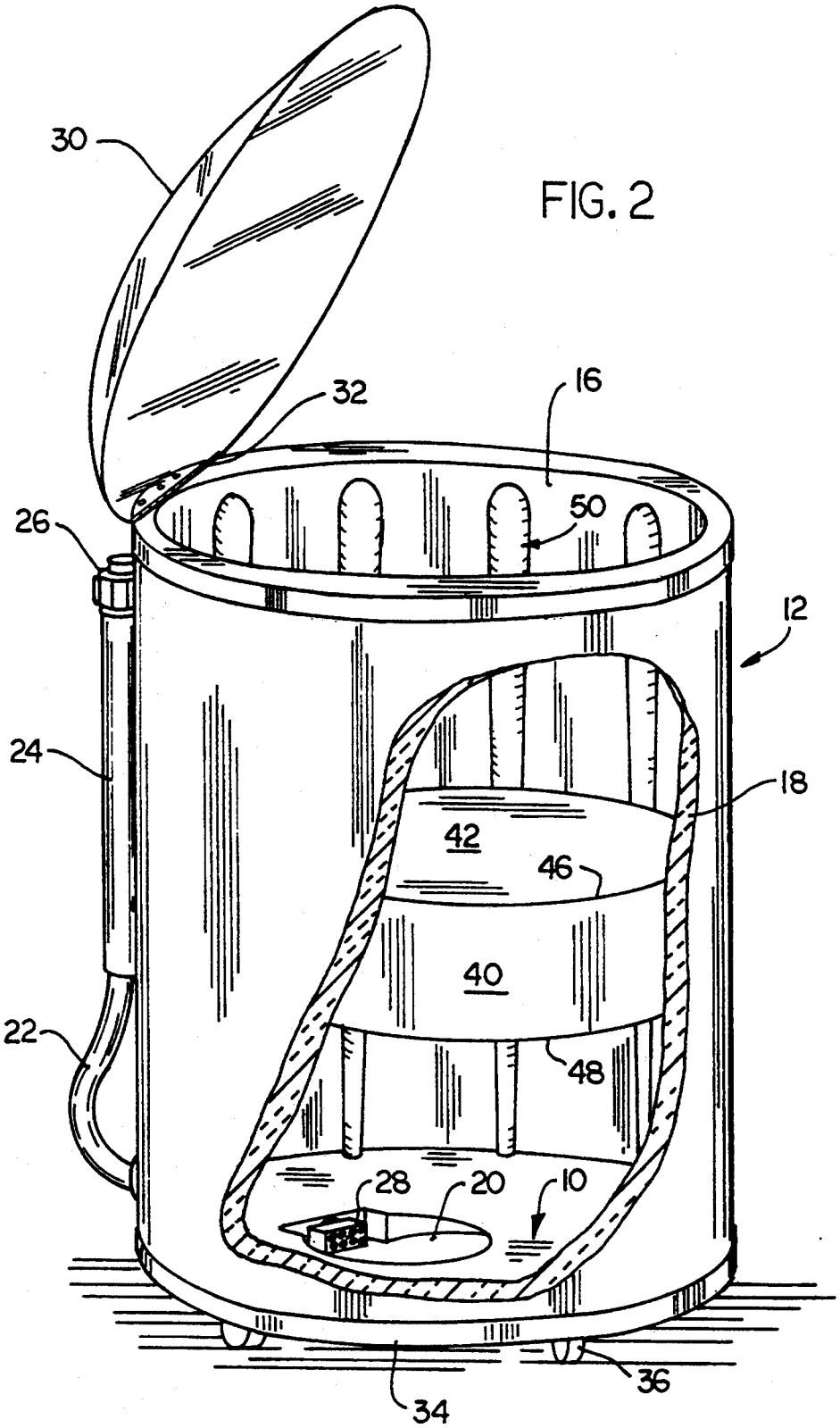
FIG. 2 is a cut away, perspective view of a container of the present invention with a diverging side wall and vertical ribs.
Figure 3:
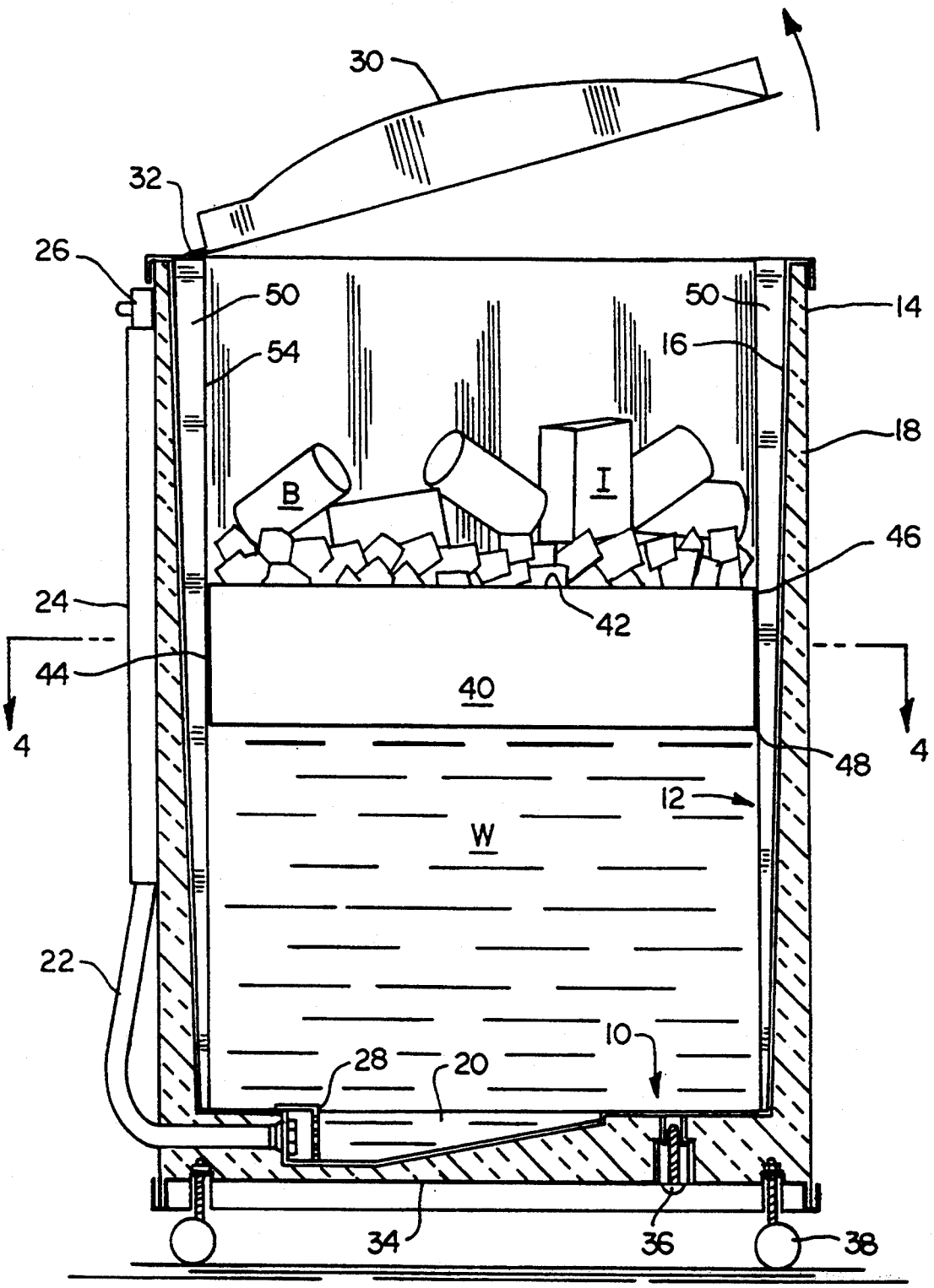
FIG. 3 is a cross-sectional plan view of the container of FIG. 2.
Figure 4:
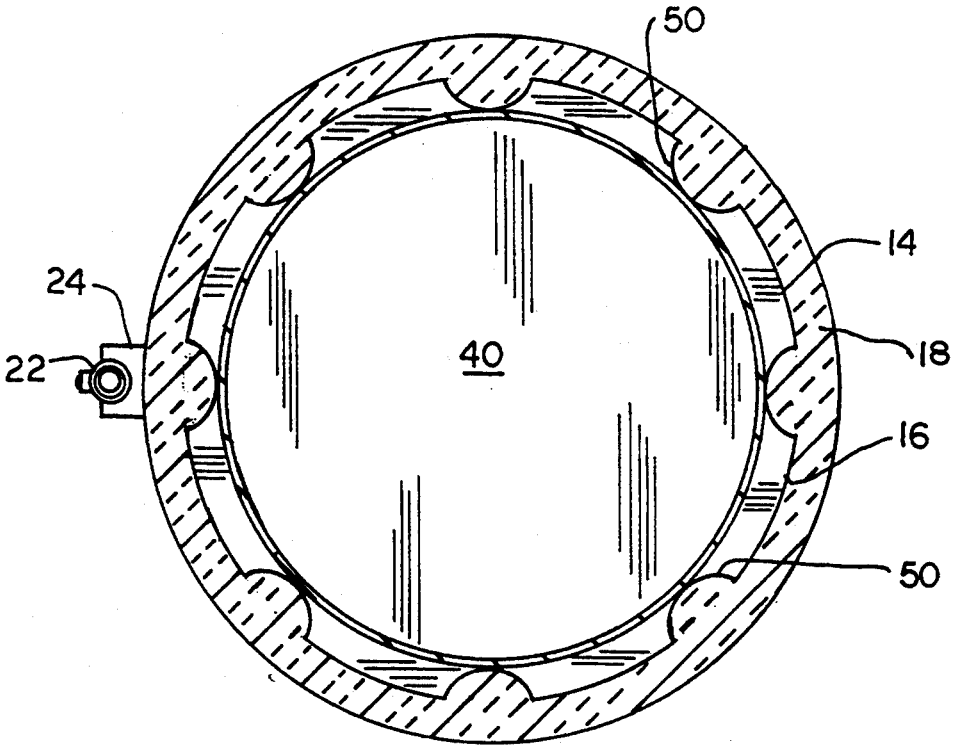
FIG. 4 is a top view of FIG. 2 along line 4—4.

The preferred embodiment of the chilled beverage container has a receptacle having a bottom wall, generally 10, a side wall, generally 12, integral at its lower edge with bottom wall 10. Walls 10 and 12 may include an outer segment 14 and a spaced inner segment 16, which are separated by a cavity 18, filled with, e.g., styrofoam.

Since the styrofoam provides strength to walls 10 and 12, it is not essential that segments 14 and 16 are of sufficient strength to support the weight of the receptacle contents. Wall segment 16 may, for example, be formed of a thin sheet of graphic material used primarily to improve the outer appearance of the container and provide an advertising surface.

Bottom wall 10 has a recess 20 therein. A drain hose 22 extends from recess 20 to the exterior of the receptacle. Drain hose 22 is detachably held against wall 12 in holder 24. Hose 22 has a valve 26 at its terminal end to control water flow. A drain cover 28 in recess 20 prevents entry of debris.

A transparent, convex top 30 is attached to the upper edge of wall 12 by hinge 32.

A horizontal support base 34 is secured to the exterior of bottom wall 10 by bolts 36, adhesive, or other conventional means. Support base 34 includes a plurality of casters 38, to facilitate movement of the container when filled.

Containers, such as cans or bottles, of beverages (B) and ice (I) are supported in the receptacle cavity on a float 40, which rests on water (W) produced by melting ice. Float 40 is lighter than water and is formed of blow-molded polyethylene. Since one cubic foot of air supports sixty-two pounds, one skilled in the art will be able to readily calculate the volume of air which needs to be enclosed by the float to support a desired quantity of ice and beverages.

Float 40 includes a float top wall 42, and a float side wall 44 which has an upper edge 46 integral with wall 42, and a lower edge 48 spaced from upper edge 46. The float 40 is, of course, buoyant in water, and can be filled with air or other lightweight material. Preferably, the material is such that it is not absorbent, so that if the float is punctured, the buoyancy will not be adversely affected.

Figure 5:
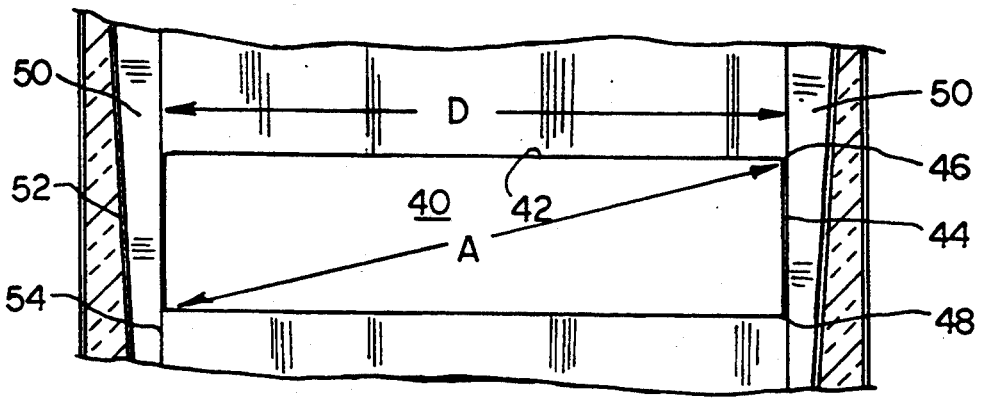
FIG. 5 is a cross-sectional plan view of the float and opposed ribs, illustrating the dimensions required to prevent tipping of the float in the cavity.

It is important that the float not tip during use. As illustrated in FIG. 5, tipping can be prevented if the diameter "D" of the interior cavity is less than the distance "A" from a point on one edge of the side wall to a point on the opposing edge of the side wall at a diametrically opposed point on the float. It is also desirable that the diameter "D" be not too close to the distance "A", in order to prevent jamming of the float in the cavity if minor tipping does occur.

When the receptacle has an interior cavity with a vertical side wall, as shown in FIG. 1, side wall 44 is adjacent inner wall segment 16, with the separation between wall 44 and segment 16 being only sufficient to allow water to flow between them and allow upward movement of float 40. Generally, this separation will be from about one-sixteenth to about one-eighth inch.

When inner wall segment 16 is formed of molded plastic, however, the segment will diverge outwardly toward the top, due to the mold configuration required for mold release. When using an inner wall segment of this type, it is desirable to incorporate a plurality of upright ribs 50 as shown in FIGS. 2–5. Ribs 48 have an outer face 52 positioned against inner wall segment 16 and a vertical inner face 54 toward float 40.

Outer face 52 is curved to fit against wall 16, while inner face 54 is semi-circular. In this embodiment, float 40 extends across the interior cavity between opposed ribs, with side wall 44 being adjacent inner faces 54. Spacing between wall 44 and faces 54 is the same as described above for spacing between wall 44 and segment 16 when segment 16 is vertical.

In operation, interior cavity 18 is filled with ice and beverages, which rest on float 40 at the bottom of cavity 18. As ice begins the melt, the resulting water flows between float 40 and wall 12. Float 40 begins to rise as it floats on the water, holding the beverages and remaining ice above the surface of the water and in a position where they may be readily reached by the purchaser. Periodically, water is drained from the bottom of the cavity through hose 22, and ice and beverages added to the container.

Since the water drains away from the beverage containers B and the ice I, customers will not be immersing their hands into the water. Not only is this preferable for the customer's comfort, but also reduces the likelihood of the transfer of germs from the customer's hand into the receptacle.

Also, since more of the container can be filled with ice and beverages and still locate them convenient to the customer, the receptacle can be made deeper. This allows more ice and beverages to be held. Alternatively, the receptacle can be designed to use less floor space in a retail location than prior art dispensers, without sacrificing capacity.

Certain modifications and improvements will occur to those skilled in the art upon a reading of the foregoing description. By way of example, different interior cavities from that described may be used. Also, the float may be of a shape different from the cross-sectional shape of the interior cavity, so long as tipping is avoided, and the top wall can include openings to facilitate drainage. It should be understood that all such modifications and improvements have been deleted herein for the sake of conciseness and readability, but are properly within the scope of the following claims.

What is claimed is:

1. A beverage container adapted to hold ice and beverages separate from water formed from melted ice comprising (a) a receptacle having an interior cavity with a cross-sectional extent for holding both ice and beverages; and (b) a float located within said cavity and having an area substantially filling said cross-sectional extent, a density less than water and being adapted to support the ice and beverages and move upwardly within said cavity as the ice melts.

2. A beverage container adapted to hold ice and beverages separate from water formed from melted ice comprising (a) a generally horizontal receptacle bottom wall;

(b) a continuous receptacle side wall extending upwardly from said bottom wall forming an open top receptacle having an upper rim and an interior cavity with a predetermined horizontal cross-section; and (c) a float having a cross-sectional area sufficient to substantially fill said interior cavity and a density less than water, adapted to support both the ice and beverages and move upwardly within said cavity as said ice melts.

3. The container of claim 2, further including a top attached to said rim.

4. The container of claim 2, wherein said bottom wall is generally circular and said receptacle is generally cylindrical.

5. The container of claim 2, further including a drain communicating with the lower part of said interior cavity.

6. The container of claim 2, further comprising a generally horizontal support base mounted to said bottom wall.

7. The container of claim 2, wherein said receptacle bottom and side walls are comprised of an outer section, an inner section, and insulation between said inner and outer sections.

8. A beverage container adapted to hold ice and beverages separate from water formed from melted ice comprising (a) a receptacle having an interior cavity for holding ice and beverages, said cavity having a bottom wall, a side wall, and a pre-determined horizontal cross-section; and (b) a float having a top wall extending horizontally across said cavity, and a side wall adjacent said cavity side wall, said float having a density less than water and being adapted to support the ice and beverages and move upwardly within said cavity as said ice melts.

9. The container of claim 8, wherein said float top wall has a horizontal cross-section substantially equal to said cavity horizontal cross-section.

10. A container for holding ice and beverages comprising (a) a generally horizontal receptacle bottom wall;

(b) a continuous receptacle side wall having an inner surface and an outer surface extending upwardly from said base to form an open top receptacle having an upper rim and an interior cavity, the cross-section of said interior cavity being greater at the top than at the bottom;

(c) a plurality of upstanding ribs extending inwardly from the inner the interior surface of said receptacle side wall, said ribs having vertical inner faces; and (d) a float having a density less than water adapted to support the ice and beverages and move upwardly within said cavity as the ice melts.

11. The container of claim 10, wherein said float has a top wall to support the ice and beverages, and a continuous side wall adjacent said interior faces of said ribs, said side wall having a lower edge and an upper edge.

12. The container of claim 10, wherein the distance between the inner faces of opposing ribs is less than the distance from a point on said float wall lower edge to a point on said float wall upper edge on the opposite side of said float.

13. The container of claim 10, wherein said ribs are vertical with outwardly inclined exterior faces attached to the inner surface of said side wall.

14. The container of claim 10, wherein said ribs are integrally formed with said inner surface of said side wall.

15. A method of holding containers at a chilled temperature comprising providing a receptacle having a bottom wall and sidewalls and capable of holding water, locating a float in the receptacle, loading ice and the containers to be chilled together into the receptacle on top of the float, permitting the ice to maintain the containers at a chilled temperature, draining water from melted ice to a portion of the receptacle below the float, floating the float on the drained water, and supporting remaining containers and ice on the float in the receptacle above the water.

16. A method as claimed in claim 15 wherein said loading step includes substantially entirely filling the receptacle.

17. A method as claimed in claim 15 further including removing a container after the draining step so as to decrease the weight supported by the float and thereby permit more of the float to emerge from drained water to raise the remaining containers and ice on the float.

18. A container as claimed in claim 1 further comprising a drain in said receptacle, said drain having a cover to prevent the ingress of debris.

19. A container as claimed in claim 18 wherein said receptacle has a bottom wall having a recess and said drain is located in said recess.

20. A container as claimed in claim 1 wherein said cavity for holding ice, beverages and said float extends to the bottom of said receptacle.

21. A chilled beverage dispenser comprising a receptacle having a top and an interior cavity accessible from said top, said cavity having a horizontal range and a vertical depth, a float in said cavity, said float shaped and sized to substantially fill said horizontal range and to fill only a portion of said vertical depth, ice and containers of beverages on top of said float accessible from outside said receptacle through said top, whereby said containers of beverages are chilled by said ice and accessible for removal through said top, and meltwater from said ice may drain below said float in said cavity to support said float to keep said ice and beverages elevated above meltwater.

22. A dispenser as claimed in claim 21 wherein said cavity and said float have a channel between to permit meltwater to drain from above said float to below said float.

23. A dispenser as claimed in claim 21 wherein said float is formed of blow-molded polyethylene.

24. A method of displaying chilled beverages comprising providing a receptacle having a top and an interior cavity accessible from said top, said cavity having a horizontal range and a vertical depth, disposing a float in said cavity to substantially fill the horizontal range and to fill a portion of said vertical depth, loading ice and containers of beverages on top of the float, cooling the containers of beverages with the ice, draining meltwater from said ice to a portion of the interior cavity below the float, and supporting the float on the meltwater and thereby keeping the ice and containers of beverages on top of the float elevated above meltwater.

25. A method as claimed in claim 24 further comprising the step of retrieving a container of beverage from the cavity through the top without immersing the retriever's hand in meltwater.

26. A method as claimed in claim 24 further comprising permitting almost all of the ice to melt, followed by the step of retrieving a container of beverage from the cavity through the top without immersing the retriever's hand in meltwater.

27. A method as claimed in claim 24 further comprising raising the elevation of a lower level of product as ice melts by supporting the float on more meltwater.

* * * * *

UNITED STATES PATENT AND TRADEMARK OFFICE

CERTIFICATE OF CORRECTION

PATENT NO. : 5,433,085

DATED : July 18, 1995

INVENTOR(S) : David M. Rogers

It is certified that error appears in the above—identified patent and that said Letters Patent is hereby corrected as shown below:

Column 6:

In Claim 10, paragraph (c), line 2, delete --the interior--.

Signed and Sealed this

Seventh Day of November, 1995

Bruce Lehman

*Attest:*

BRUCE LEHMAN

*Attesting Officer*

*Commissioner of Patents and Trademarks*